US006219018B1

(12) United States Patent
Matsumoto

(10) Patent No.: US 6,219,018 B1
(45) Date of Patent: Apr. 17, 2001

(54) ACTIVE MATRIX TYPE DISPLAY DEVICE

(75) Inventor: Tomohiro Matsumoto, Hyougo-ken (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/310,152

(22) Filed: May 12, 1999

(30) Foreign Application Priority Data

May 12, 1998 (JP) ..... 10-129234

(51) Int. Cl.[7] ..... G09G 3/36

(52) U.S. Cl. ..... 345/95; 345/210

(58) Field of Search ..... 345/87, 90, 94, 345/95, 100, 208, 210

(56) References Cited

U.S. PATENT DOCUMENTS

| | | | | |
|---|---|---|---|---|
| 5,815,133 | * | 9/1998 | Tsuboyama et al. | 345/95 |
| 5,864,327 | * | 1/1999 | Kokuhata et al. | 345/90 |
| 5,933,128 | * | 8/1999 | Kuribayashi et al. | 345/95 |
| 5,995,074 | * | 11/1999 | Kusafuka et al. | 345/90 |
| 6,061,044 | * | 5/2000 | Ohno et al. | 345/95 |

* cited by examiner

*Primary Examiner*—Regina Liang
(74) *Attorney, Agent, or Firm*—Oblon, Spivak, McClelland, Maier & Neustadt, P.C.

(57) ABSTRACT

There is disclosed an improvement of an active matrix type display device which includes a switching element every pixel. In a scanning pulse which contains a first voltage for turning on the switching elements in a first voltage period, a second voltage for turning off the switching elements, and a third voltage for compensating for reduction in a video signal voltage which is supplied from signal lines, the scanning pulse in the first voltage period can set potential of a leading edge, which rises up to the first voltage, to the second voltage or less.

7 Claims, 3 Drawing Sheets

ACTIVE MATRIX TYPE DISPLAY DEVICE

BACKGROUND OF THE INVENTION

1. Field of the Invention

The present invention relates to a flat panel display device and, more particularly, an active matrix type display device in which a switching element is provided to each display pixel.

2. Description of the Related Art

The flat panel display device being represented by the liquid crystal display device is utilized in various fields because it is thin and light in weight and low power consumption. Since the active matrix type liquid crystal display device in which switching elements are provided to the display pixels respectively can suppress cross-talk between neighboring display pixels to the lowest minimum, it is utilized in the fields in which the high definition display images are required particularly.

In the active matrix type liquid crystal display device which is spread commonly at present, a twisted nematic (TN) type liquid crystal is held between an array substrate and an opposing substrate via alignment films. A plurality of scanning lines and a plurality of signal lines are arranged mutually in a matrix fashion via an insulating film on the array substrate. Switching elements such as thin film transistors (TFTs), etc. are arranged in the vicinity of the intersections of respective lines, and then pixel electrodes are arranged via the switching elements. Also, opposing electrodes are arranged on the opposing substrate so as to oppose to the pixel electrodes.

In such liquid crystal display device, in order to prevent an event that electrical charges stored in the liquid crystal capacitances Clc are leaked through the switching elements to thus degrade display quality, auxiliary capacitances Cs are connected in parallel with the liquid crystal capacitances Clc of respective display pixels. There are two types of the array substrate configurations to which the auxiliary capacitances Cs are connected. One is the independent Cs line type array substrate in which auxiliary capacitance lines are provided in substantially parallel with the scanning lines and overlapped with pixel electrode via the insulating film so as to form the capacitance between the pixel electrode and the auxiliary capacitance line. The other is the Cs-on gate type array substrate in which the capacitance is formed between the scanning line at the preceding stage and the pixel electrode, which is arranged to be partially overlapped via the insulating film, along the scanning direction. The Cs-on gate type array substrate has such an advantages that, since unnecessary wirings like the auxiliary capacitances line can be omitted, a higher aperture ratio can be achieved.

However, according to the Cs-on gate type device, since the pixel electrodes are overlapped partially with the scanning line provided to the preceding stage, there is such a problem that flicker becomes obvious particularly in the high definition liquid crystal display device. The cause of the flicker will be explained hereunder.

FIG. 1 is an equivalent circuit diagram of pixels of a conventional Cs-on gate type device. TFT (i, j) and TFT (i, j+1) are arranged as switching elements in the vicinity of intersections between the signal line Xi and the scanning lines Yj, Yj+1. Drain electrodes of the TFTs are connected to the signal line Xi, and gate electrodes of the TFTs are connected to the scanning lines Yj, Yj+1 respectively. Also, source electrodes of the TFTs are connected to the pixel electrodes E respectively. A liquid crystal layer LC is held between the pixel electrodes E and opposing electrodes C. A liquid crystal capacitances Clc is formed by this liquid crystal layer LC. An auxiliary capacitance Cs is connected between the pixel electrode E and the neighboring scanning line in electrically parallel with the liquid crystal capacitance Clc.

Next, the case where horizontal pixel lines are sequentially scanned from the top will be explained with reference to a display pixel which is provided to an intersection portion between the signal line Xi and the scanning line Yj.

FIG. 2 is a voltage waveform diagram showing waveforms of pulses which are applied to the signal lines and the scanning lines in FIG. 1. In FIG. 2, VXi denotes a signal pulse which is applied to the signal line Xi, and VYj, VYj+1 denote scanning pulses which are applied to the scanning lines Yj, Yj+1 respectively. As shown in FIG. 1, various parasitic capacitances such as a gate-drain capacitance Cgd of the TFT (i, j), a scanning line-pixel electrode capacitance Cgs including a gate-source capacitance of the TFT (i, j), a signal line-scanning line capacitance Cg_s, a scanning line-opposing electrode capacitance Cg_c, etc. in addition to its own wiring resistance are present on the scanning line Yj. Therefore, the trailing edge of the scanning pulse VYj which is applied from the scanning line Yj to a gate of the TFT becomes gentle due to an influence of various parasitic capacitances and is deviated from an ideal waveform which is indicated by a broken line in FIG. 2. Thus, the leading edge/the trailing edge of the waveform is delayed, as shown by a solid line in FIG. 2.

In the event that the scanning pulse VYj is applied to the scanning line Yj and also the scanning line Yj+1 provided at the succeeding stage is not turned on until the scanning pulse VYj is reduced below a threshold value of the TFT (i, j), the liquid crystal capacitance Clc at the succeeding stage and the auxiliary capacitance Cs are connected in series with each other to the scanning line Yj. At this time, for example, the capacitance connected to the scanning line Yj can be given by $$Cgd+Cgs+Cg_s+Cg_c+\{Cs\cdot Clc/Cs+Clc\} \quad (1)$$

However, in the event that delay of the scanning pulse is caused and also the TFT (i, j+1) of the scanning line Yj+1 provided at the succeeding stage is turned on before the scanning pulse VYj is reduced below the threshold value (Vth) of the TFT (i, j), for example, the capacitance connected to the scanning line Yj can be given by $$Cgd+Cgs+Cg_s+Cg_c+Cs \quad (2)$$

This capacitance is increased rather than that given by Eq. (1).

In this manner, in the Cs-on gate type liquid crystal display device, if on-periods of the TFTs are overlapped effectively between neighboring scanning lines Yj and Yj+1, the capacitance coupled to the scanning line Yj is increased and thus a waveform of the scanning pulse VYj is further delayed. In particular, in the high precision liquid crystal display device, if one horizontal scanning period becomes shorter, an interval between the scanning pulses is also reduced and thus the on-periods of the TFTs are ready to overlap with each other. In addition, since the numbers of the TFTs, etc. are increased, parasitic capacitances are increased and thus delay of the scanning pulse VYj is accelerated. Therefore, according to the liquid crystal display device in the prior art, with the progress of high definition, considerable difference in a delay amount of the scanning pulse is caused between the power supply side of the scanning pulse VYj and the end point side because of the above reason, and therefore deterioration of display quality such as flicker, etc. is easily generated.

SUMMARY OF THE INVENTION

It is an object of the present invention to provide an active matrix type liquid crystal display device capable of implementing a high-definition display image be suppressing generation of flicker, while achieving a higher aperture ratio by a configuration of a Cs on-gate type device.

In order to achieve the above object, according to the present invention, there is provided an active matrix type display device comprising a display panel including an array substrate having pixel electrodes which are connected in vicinity of respective intersection points between a plurality of signal lines and a plurality of scanning lines, which are arranged so as to intersect mutually, via switching elements, an opposing substrate which is arranged so as to oppose to the array substrate, and an optical modulating layer which is held between the array substrate and the opposing substrate; a signal driving means for supplying a video signal voltage onto the signal lines; and a scanning line driving means for supplying sequentially a scanning pulse, which contains a first voltage for turning on the switching elements in a first voltage period, a second voltage for turning off the switching elements, and a third voltage for compensating for variation in potential of the pixel electrodes, to the scanning lines based on a vertical clock signal and a vertical start signal; wherein each of the pixel electrodes, which is connected to one scanning line of the display panel via one of the switching elements, is arranged to electrically form a capacitance together with another neighboring scanning line via a dielectric layer, and the scanning line driving means sets an initial section of change, in which the scanning pulse in the first voltage period is varied to the first voltage, to a predetermined voltage by which the switching elements are turned off.

According to the above configuration, even if a delay is caused in the leading edge/trailing edge of the first voltage of the scanning pulses, an ON period of the TFT connected to one scanning line and an ON period of the TFT connected to a neighboring scanning line are not overlapped effectively. In other words, such a situation can be prevented that the switching element connected to another neighboring scanning line is turned of before the scanning pulse being output onto one scanning line is lowered below a threshold value of the switching element. Hence, the capacitance connected to the scanning line is never increased. As a result, since considerable difference in a delay amount of the scanning pulse is in no way caused between the power feeding side of the scanning pulse and the end point side, generation of flicker can be suppressed.

DETAILED DESCRIPTION OF THE PREFERRED EMBODIMENTS

An embodiment of the present invention in which an active matrix type liquid crystal display device according to the present invention is applied to an active matrix type liquid crystal display device will be explained with reference to the accompanying drawings hereinafter.

At first, a circuit configuration of a liquid crystal display device according to an embodiment of the present invention will be explained hereunder.

Figure 3:
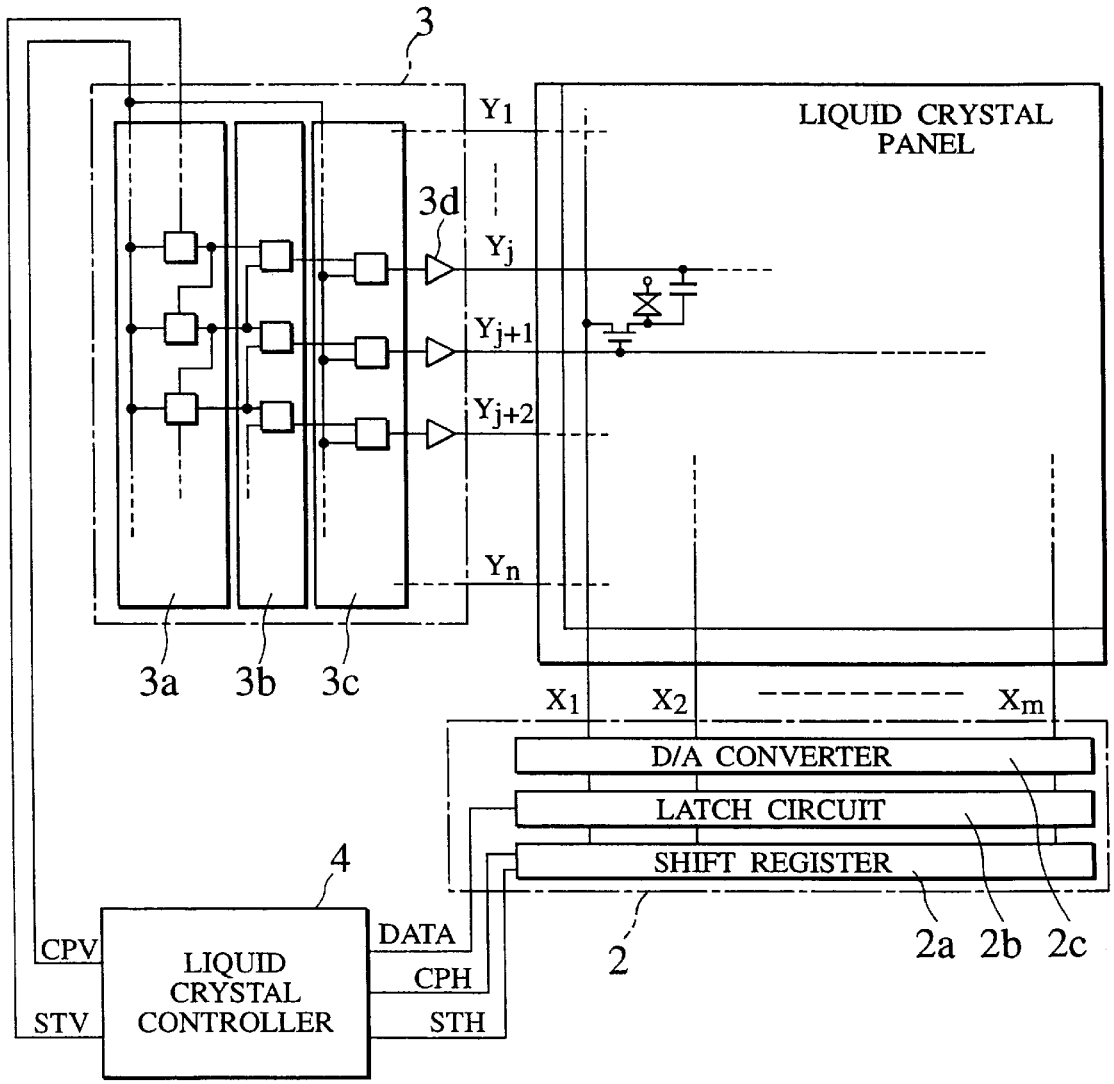
FIG. 3 is a block diagram showing a basic circuit configuration of a liquid crystal display device according to an embodiment of the present invention.

FIG. 3 is a block diagram showing a basic circuit configuration of a liquid crystal display device according to an embodiment of the present invention. The liquid crystal display device comprises a liquid crystal panel 1, X driver 2 and a Y driver 3 for driving the liquid crystal panel 1 respectively, and a liquid crystal controller 4 for supplying various signals to the X driver 2 and the Y driver 3. In this case, the liquid crystal panel 1, the X driver 2, and the Y driver 3 can be formed integrally on the same substrate if a polysilicon (p-Si) is utilized, for example.

Figure 1:
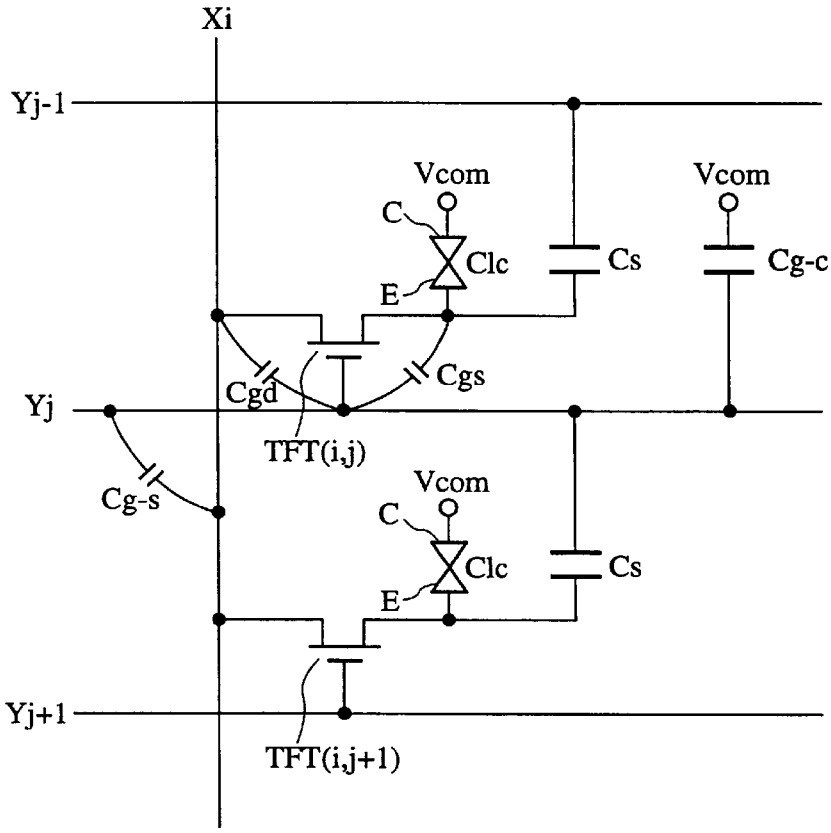
FIG. 1 is an equivalent circuit diagram of pixels in a normal Cs-on gate type device.

The liquid crystal panel 1 is constructed, for example, as a light transmission type display panel which displays the image by using a light emitted from a light source as a back light. TFTs, pixel electrodes E, an opposing electrode C, a liquid crystal layer LC being held between these electrodes, etc., which are shown in FIG. 1, for example, are arranged in the vicinity of respective intersection points between signal lines X1, X2, . . . , Xm and scanning lines Y1, Y2, . . . , Yn.

An amorphous silicon (a-Si) is employed as an active layer of the TFT. Also, Cs-on gate type pixels are employed as an array substrate configuration to add an auxiliary capacitance Cs. In other words, the auxiliary capacitance Cs is formed by the pixel electrode E and other scanning line positioned at the preceding stage rather that the pixel electrode E in the scanning direction if they are superposed with each other via an insulating film as a dielectric layer. This auxiliary capacitance Cs has a capacitance in excess of at least half of a liquid crystal capacitance Clc.

The X driver 2 is composed of a circuit which comprises a shift register 2*a*, a latch circuit 2*b*, and a D/A converter 2*c*. Then, an analog video signal (Vs) is output to signal lines X1, X2, . . . , Xm based on a digital video signal (DATA) which is input in synchronism with a horizontal clock signal (CPH) and a horizontal start signal (STH).

The Y driver 3 is composed of a circuit which comprises a shift register 3*a* in which a plurality of flip-flops are cascade-connected; a first logic portion 3*b* for setting respective outputs of the shift register 3*a* to a third voltage, which compensates for potential variation of the pixel electrode E into which the analog video signal (Vs) is written, for a predetermined period; a second logic portion 3*c* for setting respective outputs of the first logic portion 3*b* to the third voltage for a predetermined period in a rise time; and an output buffer 3*d*. The Y driver 3 output sequentially a scanning pulse of a waveform, which is described later, to scanning lines Y1, Y2, . . . , Yn in synchronism with a vertical clock signal (CPV) and a vertical start signal (STV).

Figure 4:
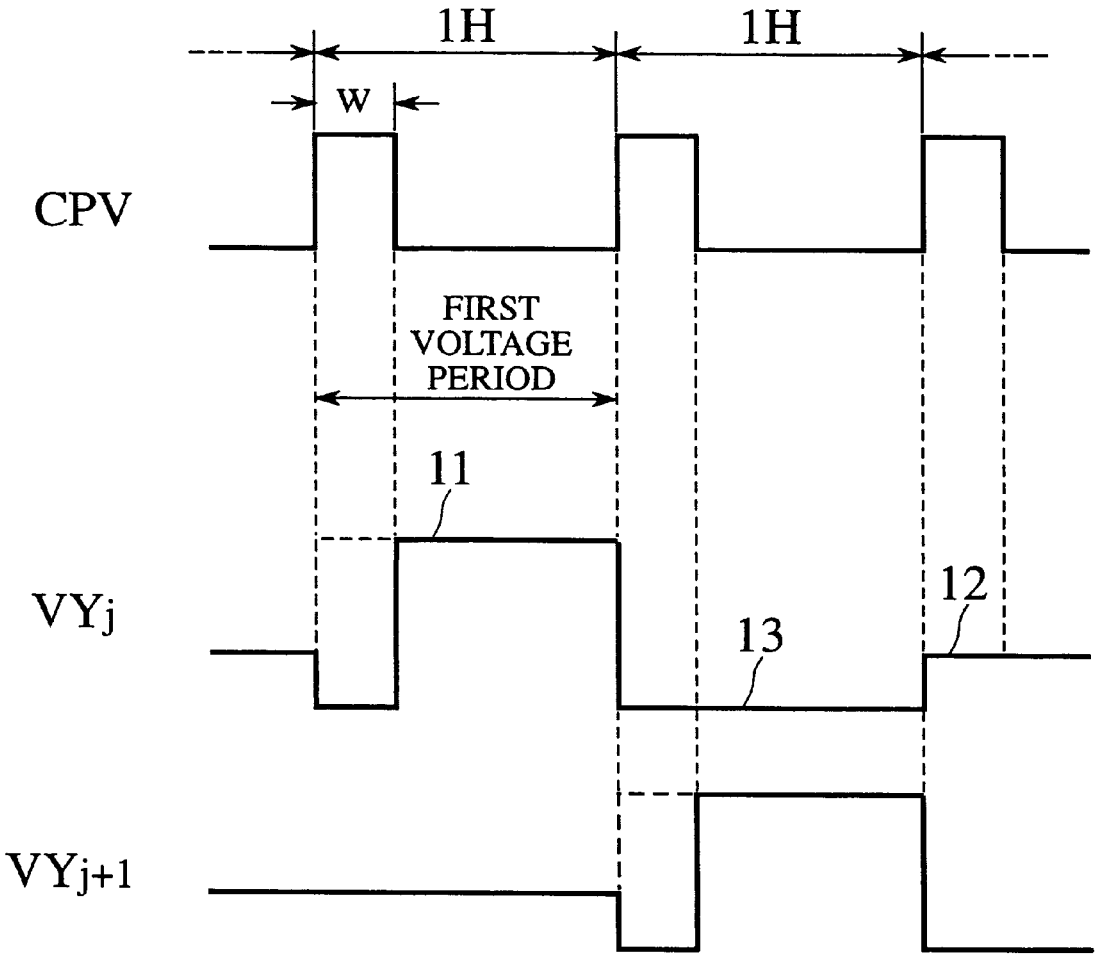
FIG. 4 is a voltage waveform diagram showing waveforms of scanning pulses being output from a Y-driver in FIG. 3.

FIG. 4 is a voltage waveform diagram showing a waveform of the scanning pulse which is output from the Y driver 3. Scanning pulses VYj, VYj+1 show potentials applied to scanning lines Yj, Yj+1 in FIG. 1, for example. A scanning pulse VY containing first voltage 11 of +20 V which is used to turn on a TFT as a switching element, a second voltage 12 of −6 V which is used to turn off the TFT, and a third voltage 13 (compensation pulse) of −11 V which is used to compensate for potential variation of the pixel electrode E is output sequentially to the scanning lines Y1, Y2, . . . , Yn in synchronism with the vertical clock signal (CPV). In this case, numeric values of the above voltages are given merely as one particular example.

Flip-flops in the first logic portion 3*b* set outputs from the flip-flops in the shift register 3*a* to the third voltage based on outputs from the flip-flops in the preceding stage respectively. In this embodiment, an amorphous silicon (a-Si) is employed as the active layer of the TFT. This TFT is operated as an N-channel device. Hence, charges which are written into the pixel electrode E are redistributed into various capacitances during when the voltage of the scanning pulse VY is lowered from an ON-level to the second voltage 12 as an OFF-level, so that potential of the pixel electrode E is reduced. Therefore, the third voltage 13 is set to −11 V, for example, so as to compensate for reduction in potential if the pixel electrode E.

In contrast, if the TFT is operated as a P-channel device, charges which are written into the pixel electrode E are redistributed into various capacitances during when the voltage of the scanning pulse VY is increased from the ON-level to the OFF-level, so that potential of the pixel electrode E is increased. In this case, the third voltage 13 is set to a voltage in excess of the OFF-level.

When the outputs of the first logic portion 3*b* are in a high-level period and also the vertical clock signal (CPV) is in a high-level period, the second logic portion 3*c* sets outputs of the first logic portion 3*b* to a predetermined voltage at which the TFT is turned off. In this embodiment, potential of a leading edge (initial section of change) in the first voltage period is set to a potential equal to the third voltage 13 only in a period which corresponds to a pulse width (W) of the vertical clock signal(CPV).

In this way, in the first voltage 11 contained in the scanning pulse VY, the potential of the leading edge in the first voltage period is set to the same potential as the third voltage 13 only in the period which corresponds to the pulse width (W) of the vertical clock signal (CPV). This is because start potential of a compensation pulse must be increased when the TFT is turned off. This potential of the leading edge may be set to a voltage by which the TFT can be sufficiently turned off, e.g., less than the second voltage 12.

An interval between the period in which the potential of the leading edge in the first voltage period is set to the potential equal to the third voltage 13, i.e., the period in which the first voltage 11 is being output in the first voltage period of the scanning pulse VYj which is output onto the scanning line Yj, and the period in which the first voltage 11 is being output in the first voltage period of the scanning pulse VYj+1 which is output onto the scanning line Yj+1 is set longer that a time constant of the scanning line Yj. In this embodiment, the first voltage period is set to 20 $\mu$ sec, while the above interval is set to 5 $\mu$ sec which is enoughly longer than the time constant of the scanning line Y. Of course, the above interval may be modified variously if the period in which the first voltage 11 is being output can assured in excess of a period which is enough to write the analog video signal (Vs) into the pixel electrode E via the TFT, e.g., more than 10 $\mu$ sec.

In this embodiment, the interval of 5 $\mu$ sec is set under the assumption that the period in which the potential of the leading edge of the first voltage period of the scanning pulse VY is set to the same potential as the third voltage 13 is the period which corresponds to the pulse width (W) of the vertical clock signal. This assumption is applied to simplify the configuration which is used to set the period in which the potential is set to the equal potential to the third voltage 13. Therefore, such period in which the potential is set to the equal potential to the third voltage 13 is not limited to the pulse width (W) of the vertical clock signal (CPV). In addition, the period in which the first voltage 11 is output may be set shorter that one horizontal scanning period (1H), and the period in which the third voltage 13 is output may be set substantially equal to one horizontal scanning period (1H).

Figure 2:
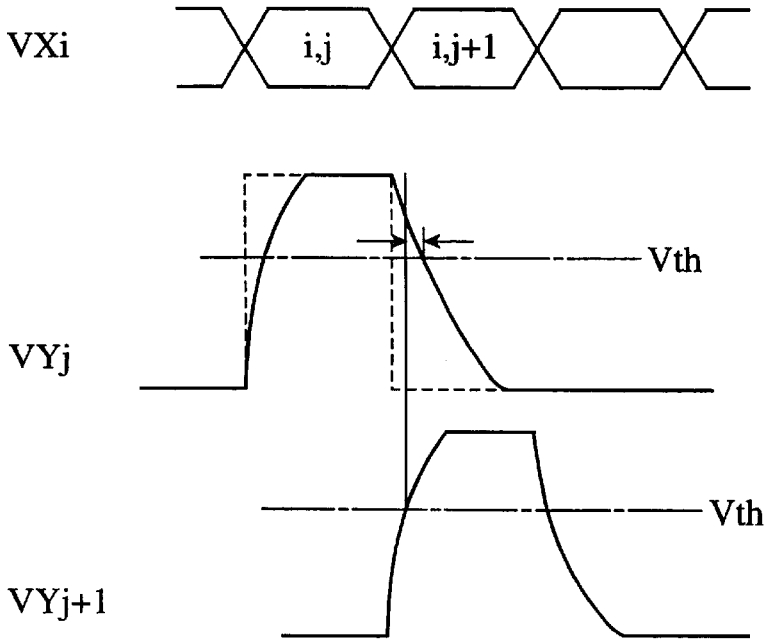
FIG. 2 is a voltage waveform diagram showing waveforms of pulses which are applied to signal lines and scanning lines in FIG. 1.

If the case where the above scanning pulse is applied to the scanning lines Yj, Yj+1 in FIG. 1 is considered, even if delay indicated by a solid line in FIG. 2 is caused in the leading edge/trailing edge of the first voltage 11 of the scanning pulses VYj, VYj+1, an ON period of the TFT (i, j) connected to the scanning line Yj and an ON period of the TFT (i, j+1) connected to the scanning line Yj+1 provided at the succeeding stage are not overlapped effectively. In other words, such a situation can be prevented that the TFT (i, j+1) connected to the scanning line Yj+1 provided at the succeeding stage is turned on before the scanning pulse VYj is reduced below a threshold value (Vth) of the TFT (i, j). As a result, the capacitance connected to the scanning line Yj is never increased, so that delay of the scanning pulse VYj can be reduced to the lowest minimum. Therefore, considerable difference in a delay amount of the scanning pulse VYj is in no way caused between the power feeding side of the scanning pulse VYj and the end point side, and thus generation of flicker can be suppressed effectively.

Further, the period in which the potential is set to the equal potential to the third voltage 13 can be set by using the pulse width per se of the vertical clock signal (CPV) which is supplied from a liquid crystal controller 4. Therefore, there is no necessity that a control pulse is output from the liquid crystal controller 4 to the Y-driver 3 to decide such period in which the potential is set to the equal potential to the third voltage 13. As a result, increase in the circuit configuration can be suppressed.

In the above embodiment, the period in which the potential is set to the equal potential to the third voltage 13 can be set by using the pulse width itself of the vertical clock signal (CPV) which is supplied from the liquid crystal controller 4 to the Y-driver 3. However, a previously selected period may be set in synchronism with the vertical clock signal (CPV).

What is claimed is:

1. An active matrix type display device comprising:

a display panel including an array substrate having pixel electrodes which are connected in vicinity of respective intersection points between a plurality of signal lines and a plurality of scanning lines, which are arranged so as to intersect mutually, via switching elements, an opposing substrate which is arranged so as to oppose to the array substrate, and an optical modulating layer which is held between the array substrate and the opposing substrate;

a signal driving means for supplying a video signal voltage each of the signal lines; and a scanning line driving means for supplying sequentially a scanning pulse to each of the scanning lines based on a vertical clock signal and a vertical start signal, the scanning pulse containg a first voltage for turning on the switching elements in a first voltage period, a second voltage for turning off the switching elements, and a third voltage for compensating electrical potential shifts of the pixel electrodes;

wherein each of the pixel electrodes, which is connected to one of the scanning lines of the display panel via one of the switching elements, are arranged to electrically form capacitances with neighboring another one of the scanning lines via dielectric portions, and the scanning line driving means sets an initial section of change, in which the scanning pulse in the first voltage period is varied to the first voltage, to a predetermined voltage by which the switching elements are turned off.

2. An active matrix type display device according to claim 1, wherein amorphous silicon is employed as an active layer of the switching elements.

3. An active matrix type display device according to claim 1, wherein the second voltage and the third voltage are set lower than the first voltage, and the predetermined voltage for turning off the switching elements is set to the second voltage or less.

4. An active matrix type display device according to claim 3, wherein the third voltage is set lower than the second voltage, and the predetermined voltage for turning off the switching elements is set to the third voltage.

5. An active matrix type display device according to claim 1, wherein the initial section of change is equivalent to a period which corresponds to a pulse width of the vertical clock signal.

6. An active matrix type display device according to claim 1, wherein the scanning pulse which are output for neighboring scanning lines respectively are selected such that an interval between periods in which potential is set as the first voltage is set longer than a time constant of the scanning lines.

7. An active matrix type display device according to claim 1, wherein the scanning line driving means keeps the third voltage in one horizontal scanning period following to the first voltage.

* * * * *